US010718095B2

(12) United States Patent
Abeles

(10) Patent No.: US 10,718,095 B2
(45) Date of Patent: Jul. 21, 2020

(54) BEACH EROSION INHIBITOR

(71) Applicant: Gary E. Abeles, Verona, NJ (US)

(72) Inventor: Gary E. Abeles, Verona, NJ (US)

( * ) Notice: Subject to any disclaimer, the term of this patent is extended or adjusted under 35 U.S.C. 154(b) by 0 days.

(21) Appl. No.: 16/480,476

(22) PCT Filed: Jan. 8, 2018

(86) PCT No.: PCT/US2018/012781
§ 371 (c)(1),
(2) Date: Jul. 24, 2019

(87) PCT Pub. No.: WO2018/140219
PCT Pub. Date: Aug. 2, 2018

(65) Prior Publication Data

US 2019/0382974 A1 Dec. 19, 2019

Related U.S. Application Data

(60) Provisional application No. 62/451,394, filed on Jan. 27, 2017.

(51) Int. Cl.
*E02B 3/04* (2006.01)

(52) U.S. Cl.
CPC ..... *E02B 3/04* (2013.01)

(58) Field of Classification Search
CPC ..... E02B 3/04
USPC ..... 405/15, 16, 302.4, 302.6
See application file for complete search history.

(56) References Cited

U.S. PATENT DOCUMENTS 2,474,786 A * 6/1949 Humphrey ..... E02B 3/06 405/30
3,280,569 A * 10/1966 Wosenitz ..... E02B 3/06 405/34
3,653,216 A * 4/1972 Stickler, Jr. ..... E02B 3/04 405/33

(Continued)

FOREIGN PATENT DOCUMENTS

WO 2006031525 A2 3/2006

OTHER PUBLICATIONS

PCT International Search Report and Written Opinion for Appl No. PCT/US2018/012781 dated Apr. 27, 2018, 12 pages.

(Continued)

*Primary Examiner* — Benjamin F Fiorello
(74) *Attorney, Agent, or Firm* — Maine Cernota & Rardin

(57) ABSTRACT

An apparatus for impeding beach erosion is light, inexpensive to install, and easy to remove. The apparatus includes a sea-facing barrier wall penetrated by large holes that allow water mixed with sand to enter the apparatus. After the entrained sand has settled, the water drains out through smaller holes provided in a rear wall. The top of the barrier wall can be curved to direct water back toward the sea. The barrier wall can extend above the rear wall, and a backstop wall can be provided that forms an additional sand-collecting chamber behind the rear wall. The walls can be made from plywood, metal, or plastic between one quarter and two inches thick. Embodiments can be disassembled and/or folded for transport and storage. Internal reinforcing partition walls can extend between the barrier and rear walls. The apparatus can be anchored by a base and/or anchoring stakes.

20 Claims, 7 Drawing Sheets

(56) References Cited

U.S. PATENT DOCUMENTS

| | | | | | |
|---|---|---|---|---|---|
| 3,844,125 | A * | 10/1974 | Williams, Sr. | E02B 3/04 | 405/33 |
| 4,129,006 | A | 12/1978 | Payne | | |
| 4,367,978 | A | 1/1983 | Schaaf et al. | | |
| 4,711,598 | A * | 12/1987 | Schaaf | E02B 3/06 | 405/21 |
| 4,818,141 | A * | 4/1989 | Rauch | E02B 3/04 | 405/21 |
| 5,176,468 | A * | 1/1993 | Poole | E02B 3/04 | 405/111 |
| 5,405,217 | A * | 4/1995 | Dias | E02B 3/06 | 405/15 |
| 5,655,851 | A * | 8/1997 | Chor | E02B 3/06 | 405/15 |
| 6,616,383 | B2 * | 9/2003 | Janz | E02B 3/04 | 405/21 |
| 8,226,325 | B1 | 7/2012 | Pierce, Jr. | | |
| 8,585,318 | B1 * | 11/2013 | Walker | E02B 3/062 | 405/21 |
| 2006/0056913 | A1 * | 3/2006 | Herzog | E02B 3/04 | 405/25 |
| 2006/0159518 | A1 | 7/2006 | Craven | | |
| 2006/0275081 | A1 * | 12/2006 | Medina Folgado | E02B 3/06 | 405/15 |
| 2010/0310313 | A1 * | 12/2010 | Kohlenberg | E02B 3/04 | 405/30 |

OTHER PUBLICATIONS

International Preliminary Report on Patentability for Appl No. PCT/US2018/012781 dated Jul. 30, 2019, 8 pages.

* cited by examiner

BEACH EROSION INHIBITOR

RELATED APPLICATIONS

This application is a US national phase application of PCT application PCT/US18/12781 filed on Jan. 8, 2018. Application PCT/US18/12781 claims the benefit of U.S. Provisional Application No. 62/451,394, filed Jan. 27, 2017. Both of these applications are herein incorporated by reference in their entirety for all purposes.

FIELD OF THE INVENTION

The invention relates to apparatus and methods of reducing and reversing beach erosion, and more particularly to apparatus and methods for capturing and retaining entrained sand from ocean waves.

BACKGROUND OF THE INVENTION

The action of ocean waves on sandy beaches often leads to significant loss of shoreline due to beach erosion, as the waves repeatedly break onto the beach, causing sand to mix with the water and wash out to sea as the waves recede. Beach erosion is an issue of significant economic, esthetic, ecological, and practical concern, such that a considerable amount of effort and cost are expended each year in various attempts to protect and rebuild beaches.

Attempts to reduce or reverse beach erosion are generally directed to re-directing or blocking the energy of ocean waves before they reach the shoreline. One approach is to install an artificial breakwater, levee, or "groin" that blocks wave action and creates a region of low wave activity that is essentially an artificial harbor or cove. However, these structures are very large and heavy, expensive to build, and nearly impossible to remove or relocate as localized requirements evolve. Also, sand often tends to collect on one side of such a breakwater or levee, and be diminished on the other side, which may not be a desired effect.

Another approach is to submerge any of various types of barriers at or beyond the low tide level so as to partially block waves as they approach the shore and thereby reduce the energy with which the waves strike the beach. Some of these barriers include open tops or flow-through holes that encourage the sea water to pool long enough for any entrained sand to settle behind them and/or within their interiors. However, such barriers are also heavy, expensive to manufacture and install, and difficult to remove or relocate as needed.

Yet another approach is to deposit heavy chunks of concrete and/or other such materials, generally referred to as "riprap," below the waterline, which also has the effect of reducing wave energy and encouraging entrained sand to settle. While somewhat less expensive to manufacture and install than other forms of underwater barrier, riprap is virtually impossible to remove or relocate. Also, riprap can tend to become buried over time as sand is deposited, thereby reducing and eliminating its effectiveness.

The most common approach to reducing beach erosion that is implemented above the waterline is the planting of shoreline-compatible grasses that tend to stabilize the sand and protect it from wind erosion, and from the onrush of wave-driven water near the high tide mark. Such grasses can further serve to filter the ocean water as it recedes, so as to strain out and retain any sand that is entrained therein. However, shoreline-compatible grasses can be expensive, difficult, and time-consuming to establish, and grasses are not a viable solution when a sand beach is desired for recreational and/or other purposes.

What is needed, therefore, is an apparatus for impeding sand beach erosion and/or rebuilding sand beaches that is light in weight, easy and inexpensive to install, and easy to remove and relocate.

SUMMARY OF THE INVENTION

An apparatus for reducing sand beach erosion and/or rebuilding sand beaches is disclosed that is light in weight, easy and inexpensive to install, and easy to remove and relocate. A method for employing the disclosed apparatus is also disclosed.

Rather than attempting to reduce or block wave energy, the disclosed apparatus filters and removes entrained sand from the water that flows upward across the beach after a wave has broken. The disclosed apparatus is therefore configured for placement near or at the high tide level, where it is not subject to strong wave action. Accordingly, the disclosed apparatus can be relatively light in weight, and is therefore less expensive to construct, easier to install, and easier to remove and/or relocate than prior art devices. As sand is accumulated by the apparatus over time, the apparatus can easily be relocated seaward, so as to build and extend the beach to any desired degree.

The disclosed apparatus comprises a rigid or semi-rigid, sea-facing barrier wall that is penetrated by a plurality of "large" holes. The barrier wall is inclined in a land-ward direction so that when a wave breaks at some location seaward of the barrier wall, the resulting rush of water is directed upward across the front surface of the barrier wall, causing at least some of the water to enter through the large holes into an interior of the apparatus behind the barrier wall.

The apparatus further comprises a rear wall and, in embodiments, also one or two side walls, which create a semi- or fully enclosed interior within which the water that enters through the large holes forms a pool, allowing entrained sand to settle. Small holes, which are smaller than the large holes, are provided in the rear wall and, in embodiments, in at least one side wall, so that sea water that has pooled within the interior can slowly drain out of the interior and return to the ocean after the entrained sand has settled out. In embodiments, the small holes are offset from the base of the apparatus so as to encourage pooling of the water before it drains through the small holes.

In some embodiments, an upper end of the barrier wall is curved seaward, so that energetically flowing water that reaches the top of the barrier wall, resulting for example from large waves generated during a storm, is directed back toward the sea and does not flow over the barrier wall to the sand behind the apparatus. In some of these embodiments, the barrier wall extends above the rear wall, and in some of these embodiments a backstop wall extends from behind the rear wall to the barrier wall at a point above the top of the rear wall, so that an additional sand-collecting chamber is formed between the backstop wall and the rear wall.

Embodiments of the disclosed apparatus are constructed from plywood, metal, from a plastic such as acrylic, from fiberglass, from particle board, which may include a laminated coating or veneer, from micro-lattice, from rigid foam, from Styrofoam, from graphene, and/or from any other suitable material. Embodiments can be easily disassembled and/or folded for transport and for storage at the deployed location or elsewhere. For example, embodiments can be folded and stored in place, and then erected when needed, such as in advance of an impending storm. Some embodiments include a bottom panel, while others do not.

Embodiments that require enhanced structural strength include internal partition walls that extend between and reinforce the barrier wall and rear wall. The partition walls are penetrated by additional, interior large holes, so that water mixed with entrained sand that enters through the large holes provided in the barrier wall is able to flow downward through the interior large holes to the bottom of the apparatus interior.

While the disclosed apparatus is not intended to withstand primary tidal and wave forces, it will generally be subject to winds, and to the residual energy of the water that flows up the front surface of the barrier wall. Some embodiments are sufficiently heavy and sturdy to withstand these forces and to remain in position without anchoring. Other embodiments include an anchoring feature, such as an enclosing base and/or anchor stakes that can be driven into the sand. So as to further reduce the cost and difficulty of installing and removing the apparatus, embodiments include a water-inflatable base.

While much of the description provided herein refers to "ocean" beaches, it should be noted that the disclosed invention is equally applicable to all sandy beaches that are exposed to wave action, including beaches adjacent to seas and large lakes.

One general aspect of the present invention is an apparatus for reducing beach erosion, the apparatus including a front barrier wall having a top and a bottom, the barrier wall being inclined backward at an angle of at least 20 degrees from vertical a plurality of large holes penetrating the barrier wall, a rear wall having a top and a bottom, the rear wall being located behind the barrier wall so that a chamber space is formed between the barrier wall and the rear wall, and a plurality of small holes penetrating the rear wall, the small holes being smaller in diameter than the large holes.

In embodiments, the rear wall is inclined from vertical in a forward direction, so that the top of the rear wall is in contact with a rear surface of the barrier wall.

In any of the preceding embodiments, the thickness of the barrier wall can be between one quarter inch and two inches.

In any of the preceding embodiments, the barrier wall and the rear wall can be made from plywood, metal, and/or plastic.

Any of the preceding embodiments can further comprise a bottom panel extending from the bottom of the rear wall to the bottom of the barrier wall.

In any of the preceding embodiments, the top of the barrier wall can be curved forward.

In any of the preceding embodiments where the rear wall is inclined from vertical in a forward direction, so that the top of the rear wall is in contact with a rear surface of the barrier wall, the apparatus can be configured such that:

- the curved top of the barrier wall extends above the top of the rear wall;
- the apparatus further includes a backstop wall having a bottom and a top;
- the bottom of the backstop wall is located behind the bottom of the rear wall;
- the top of the backstop wall extends to the rear surface of the barrier wall at a height that is above the top of the rear wall, a secondary chamber space being formed between the backstop wall and the rear wall; and
- the barrier wall is penetrated by a plurality of large holes at heights between the top of the rear wall and the top of the backstop wall.

Any of the preceding embodiments can further comprise at least one side wall. In some of these embodiments at least one of the side walls is penetrated by a plurality of small holes.

In any of the preceding embodiments the small holes can have diameters that are less than one quarter inch.

In any of the preceding embodiments, the large holes can have diameters that are between one quarter inch and six inches.

Any of the preceding embodiments can further comprise a plurality of anchoring stakes configured to anchor the base to underlying sand.

Any of the preceding embodiments can further comprise a base that supports the barrier and rear walls, the base including a front retaining wall that extends vertically in front of the bottom of the barrier wall and a rear retaining wall that extends vertically behind and above the bottom of the rear wall. In some of these embodiments the base is water-inflatable. In any of these embodiments where the rear wall is inclined from vertical in a forward direction, so that the top of the rear wall is in contact with a rear surface of the barrier wall, the top of the barrier wall is curved forward, the curved top of the barrier wall extends above the top of the rear wall, the apparatus further includes a backstop wall having a bottom and a top, the bottom of the backstop wall is located behind the bottom of the rear wall, the top of the backstop wall extends to the rear surface of the barrier wall at a height that is above the top of the rear wall, a secondary chamber space being formed between the backstop wall and the rear wall, and the barrier wall is penetrated by a plurality of large holes at heights between the top of the rear wall and the top of the backstop wall, the rear retaining wall can extend vertically behind and above the bottom of the backstop wall.

And in any of the preceding embodiments, the apparatus can be configured such that the barrier wall and front wall can be pivoted about their bottoms so as to overlap with each other in a substantially flat, folded configuration.

A second general aspect of the present invention is a method for reducing erosion of a sand beach that abuts a body of water. The method includes providing an apparatus according to any embodiment of the first general aspect, installing the apparatus on the beach in an orientation wherein the barrier wall faces the water, the apparatus being installed at a location above a highest location where waves break, but in a location where water emitted by breaking waves will reach the apparatus, and allowing sand entrained in water reaching the barrier wall to accumulate within the apparatus.

Some embodiments of this second general aspect further include relocating the apparatus after sand has been accumulated therein, the accumulated sand being left behind as added beach sand. And in some of these embodiments the apparatus is relocated closer to the water, the steps of allowing sand to accumulate and relocating the apparatus being repeated so as to progressively extend the beach toward the water.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The present invention is an apparatus for reducing sand beach erosion and/or rebuilding sand beaches. The apparatus is light in weight, easy and inexpensive to install, and easy to remove and relocate. A method for employing the disclosed apparatus is also disclosed.

Rather than attempting to reduce or block wave energy, the disclosed apparatus filters and removes entrained sand from the water that flows upward across the beach after a wave has broken. The disclosed apparatus is therefore configured for placement near or at the high tide level, where it is not subject to strong wave action. Accordingly, the disclosed apparatus can be relatively light in weight, and is therefore less expensive to construct, easier to install, and easier to remove and/or relocate than prior art devices. As sand is accumulated within the apparatus over time, the apparatus can easily be moved seaward, leaving the accumulated sand behind, to build and extend the beach to any desired degree.

Figure 1A:
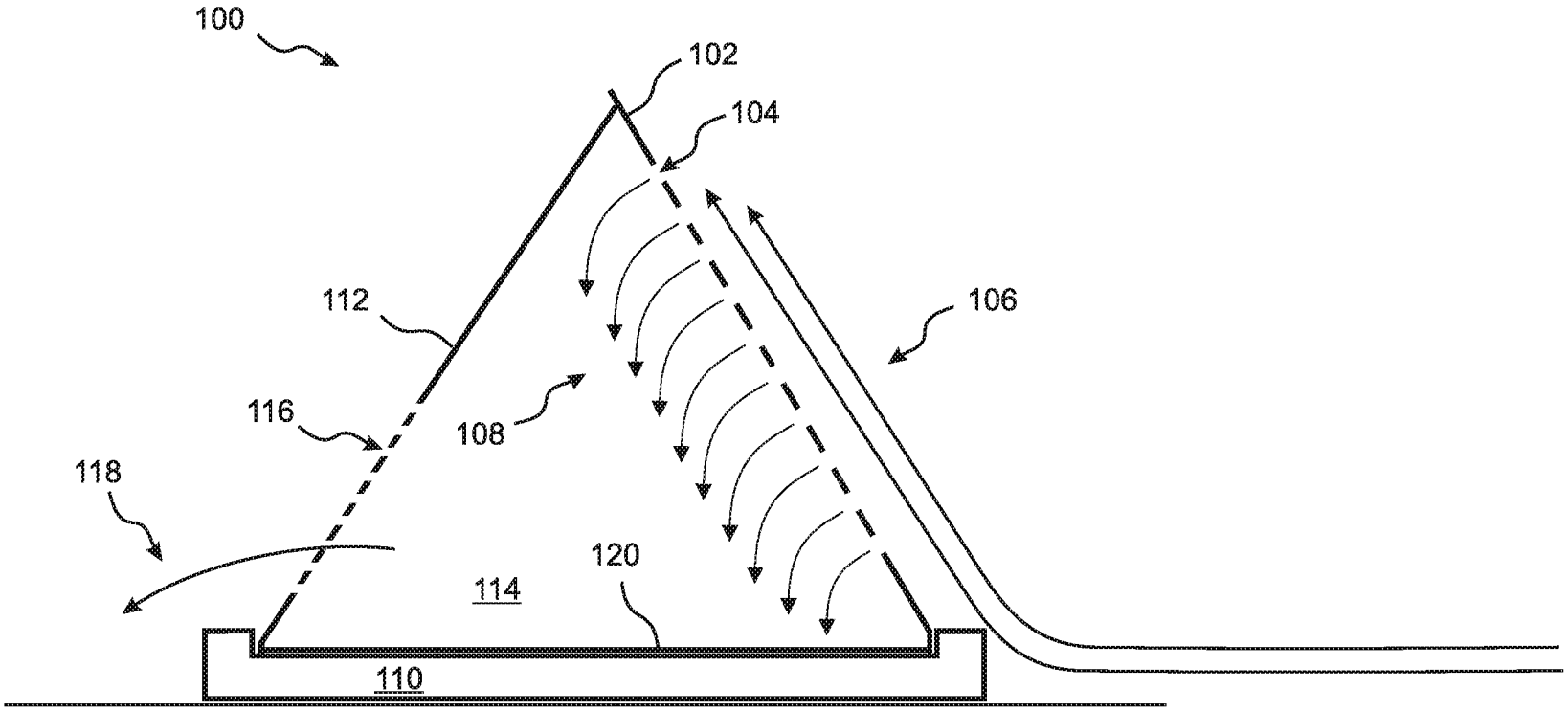
FIG. 1A is a cross-sectional view of a foldable embodiment of the present invention that includes a bottom panel and water-inflatable base, shown in a deployed configuration interacting with flowing water.

With reference to FIG. 1A, the disclosed apparatus 100 comprises a rigid or semi-rigid, sea-facing barrier wall 102 that is penetrated by a plurality of "large" holes 104, which are typically between one half inch and 6 inches in diameter. The barrier wall 102 is inclined in a land-ward direction, in embodiments by an angle of at least 20 degrees from vertical. In the embodiment of FIG. 1A, the barrier wall 102 is inclined at an angle of 30 degrees from vertical. When a wave breaks at a location below the barrier wall, the resulting rush of water 106 is directed upward across the front surface of the barrier wall 102, causing at least some of the water 108 to enter through the large holes 104 into an interior 114 of the apparatus 100 behind the barrier wall 102.

The apparatus 100 further comprises a rear wall 112 and, in embodiments, also one or two side walls (not shown), which create a semi- or fully enclosed interior 114 within which the water that enters through the large holes forms a pool that allows entrained sand to settle. "Small" holes 116 are provided in the rear wall 112 and, in embodiments, in at least one side wall, so that sea water that has pooled within the interior can slowly drain out 118 of the interior 114 and return to the ocean. These "small" holes are smaller than the "large" holes 102, and are typically less than one half inch in diameter. In embodiments the small holes are included in a section of metal or plastic screen that is installed in the rear wall and/or in one or more side walls. In the embodiment of FIG. 1A, the small holes 116 are offset from the bottom panel 120 of the apparatus, so as to encourage pooling of the water before it drains through the small holes 116. In various embodiments, this offset is between two inches and one foot.

Embodiments of the disclosed apparatus are constructed from panels 102, 112, 120 any or all of which can range in thickness between one quarter of an inch and two inches in thickness. In some embodiments, any or all of the panels 102, 112, 120 are between one quarter of an inch and one inch in thickness. In other embodiments, any or all of the panels 102, 112, 120 are between 1/32 inch and 12 inches thick.

In various embodiments, any or all of the panels 102, 112, 120 are sheets made from plywood, from metal, from a plastic such as acrylic, from fiberglass, from particle board, which may include a laminated coating or veneer, from micro-lattice, from rigid foam, from Styrofoam, from graphene, and/or from some other suitable material. Some embodiments include a bottom panel 120, while others do not.

Figure 1B:
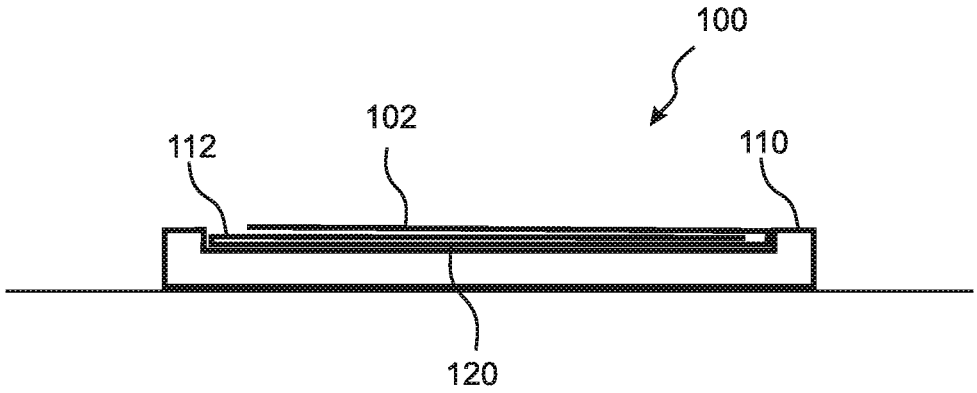
FIG. 1B is a cross-sectional view of the embodiment of FIG. 1A shown in a folded configuration.

Embodiments can be easily disassembled and/or folded for transport and for storage at the deployed location or elsewhere. With reference to FIG. 1B, embodiments can be folded and stored in place, and then erected when needed, such as in advance of an impending storm.

Figure 2:
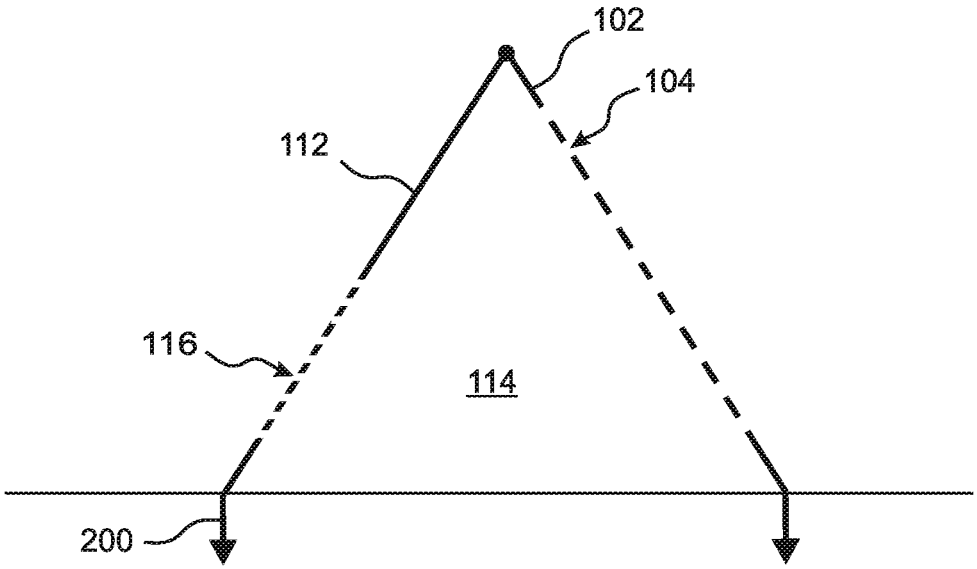
FIG. 2 is a cross-sectional view of an embodiment that does not include a base or bottom panel, and is held in place by anchoring stakes.

While the disclosed apparatus 100 is not intended to withstand primary tidal and wave forces, it will generally be subject to winds, and to the residual energy of the water that flows up the front surface of the barrier wall 102. Some embodiments are sufficiently heavy and sturdy to withstand these forces and to remain in position without anchoring, while other embodiments include an anchoring feature, such as an enclosing base. The embodiment of FIG. 1A includes a water-inflatable base 110, which further reduces the cost and difficulty of installing and removing the apparatus. As an alternative, the embodiment of FIG. 2 includes anchor stakes 200 that can be driven into the sand. This embodiment does not include a bottom panel 120.

Figure 3A:
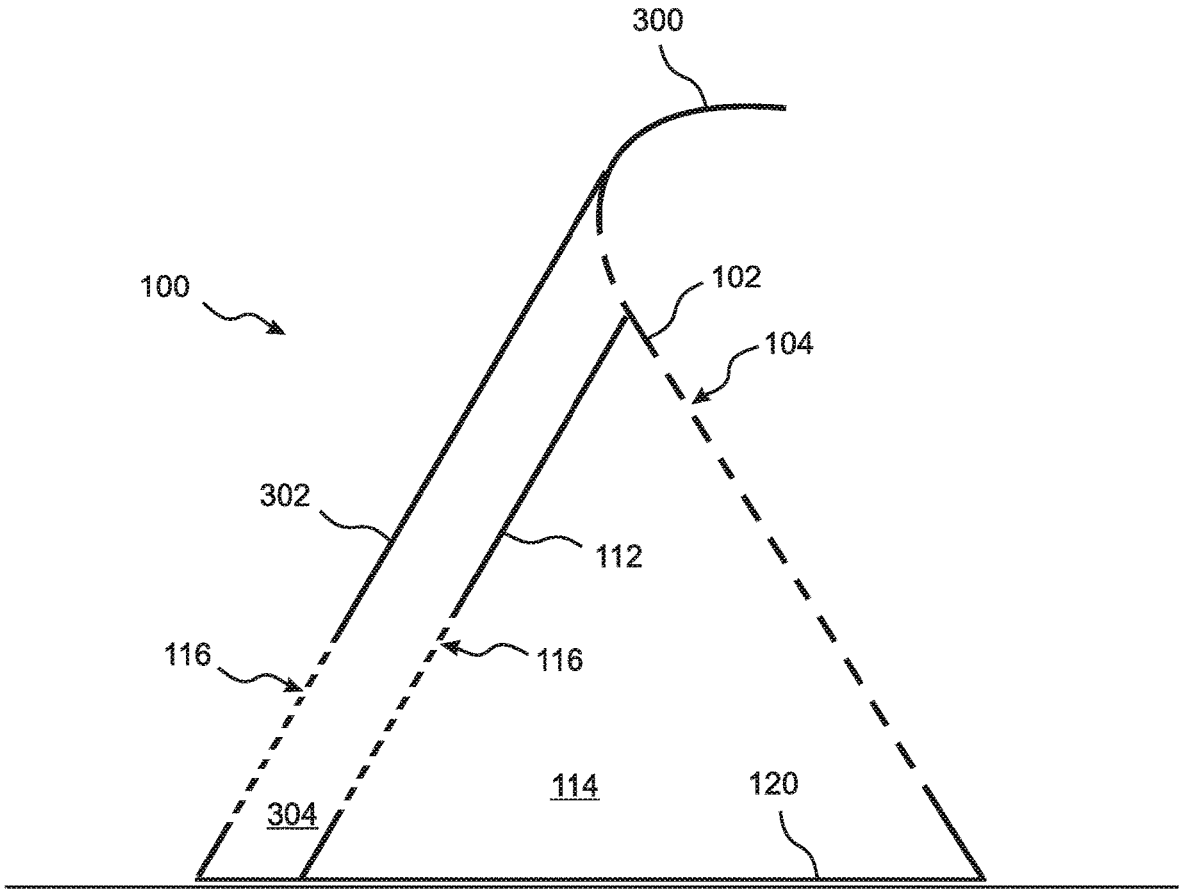
FIG. 3A is a cross-sectional view of an embodiment that includes a bottom panel but does not include a separate base, where the barrier wall includes a curved top extending above the rear wall, and the apparatus includes a backstop wall.

With reference to FIG. 3A, in some embodiments the upper end 300 of the barrier wall 102 is curved seaward, so that energetically flowing water 106 that reaches the top 300 of the barrier wall 102, resulting for example from large waves generated during a storm, is directed back toward the sea and does not flow over the barrier wall 102 to the sand behind the apparatus. In the embodiment of FIG. 3A, the barrier wall 102 extends above the top of the rear wall 112, and a backstop wall 302 extends from behind the bottom of the rear wall 112 to a height on the barrier wall 102 that above the top of the rear wall 112, so that an additional sand-collecting chamber 304 is formed between the backstop wall 302 and the rear wall 112.

Figure 3B:
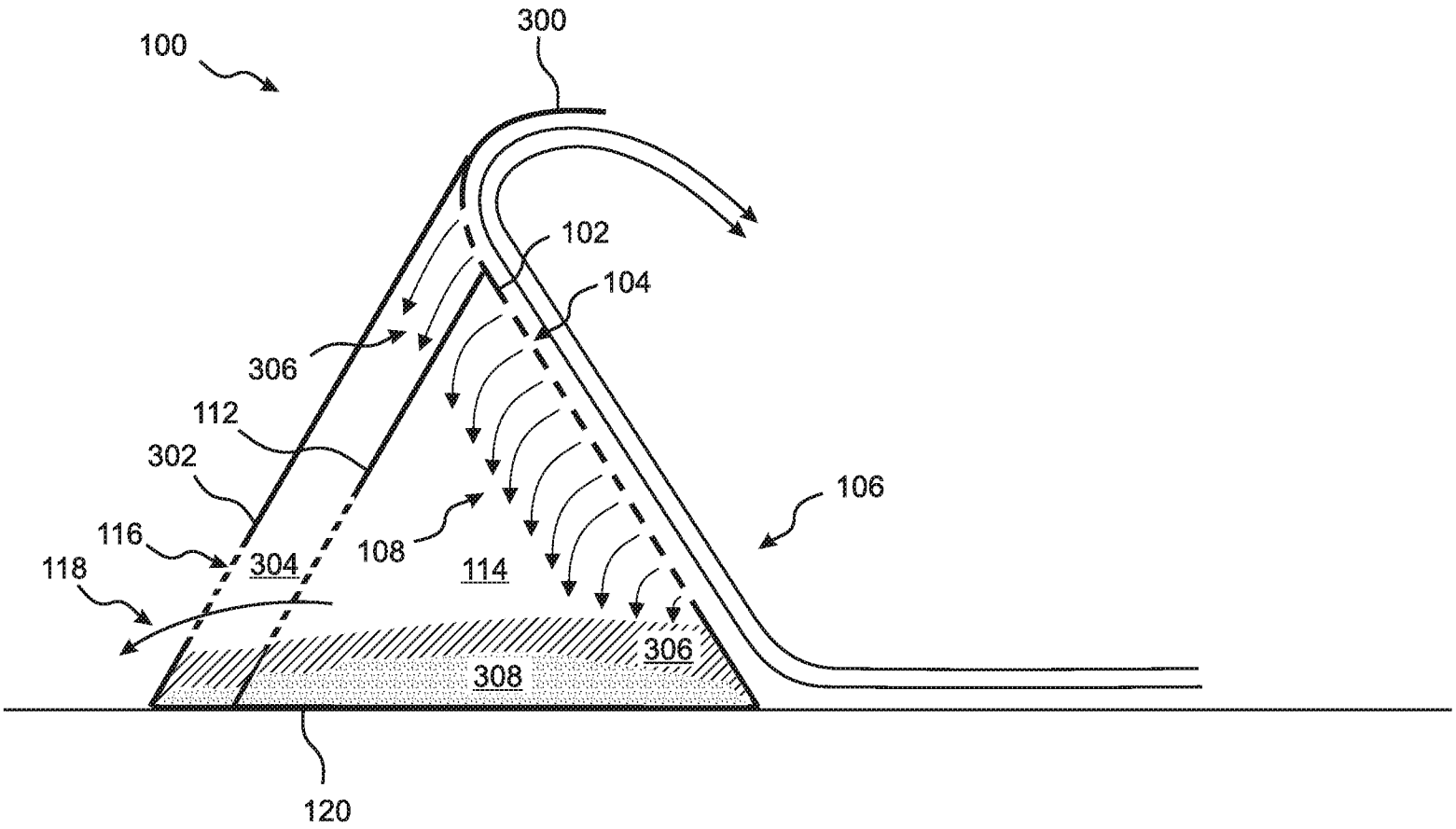
FIG. 3B is a cross-sectional view of the embodiment of FIG. 3A interacting with flowing water.
Figure 3C:
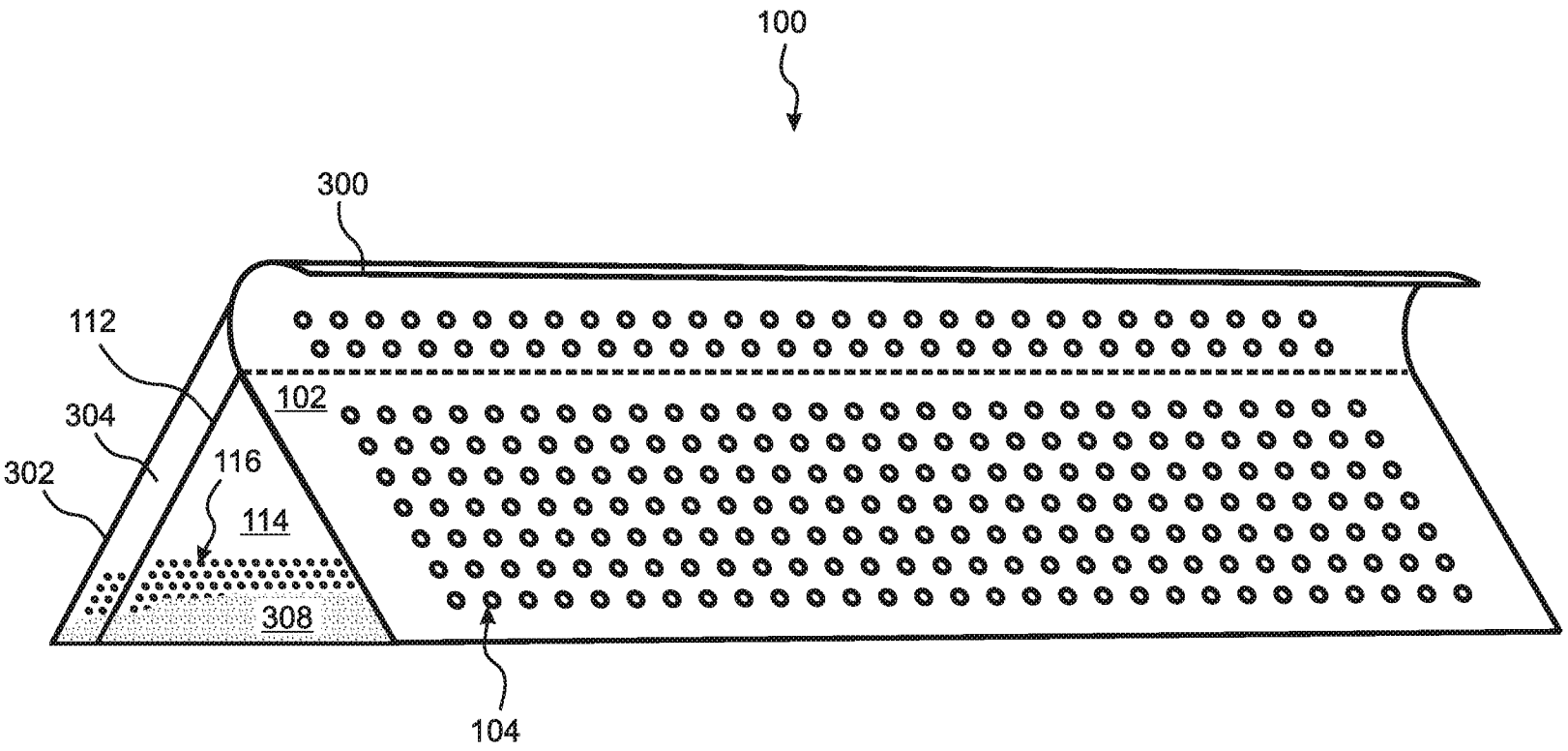
FIG. 3C is a perspective view from the front of the embodiment of FIG. 3A, shown without a side wall.
Figure 3D:
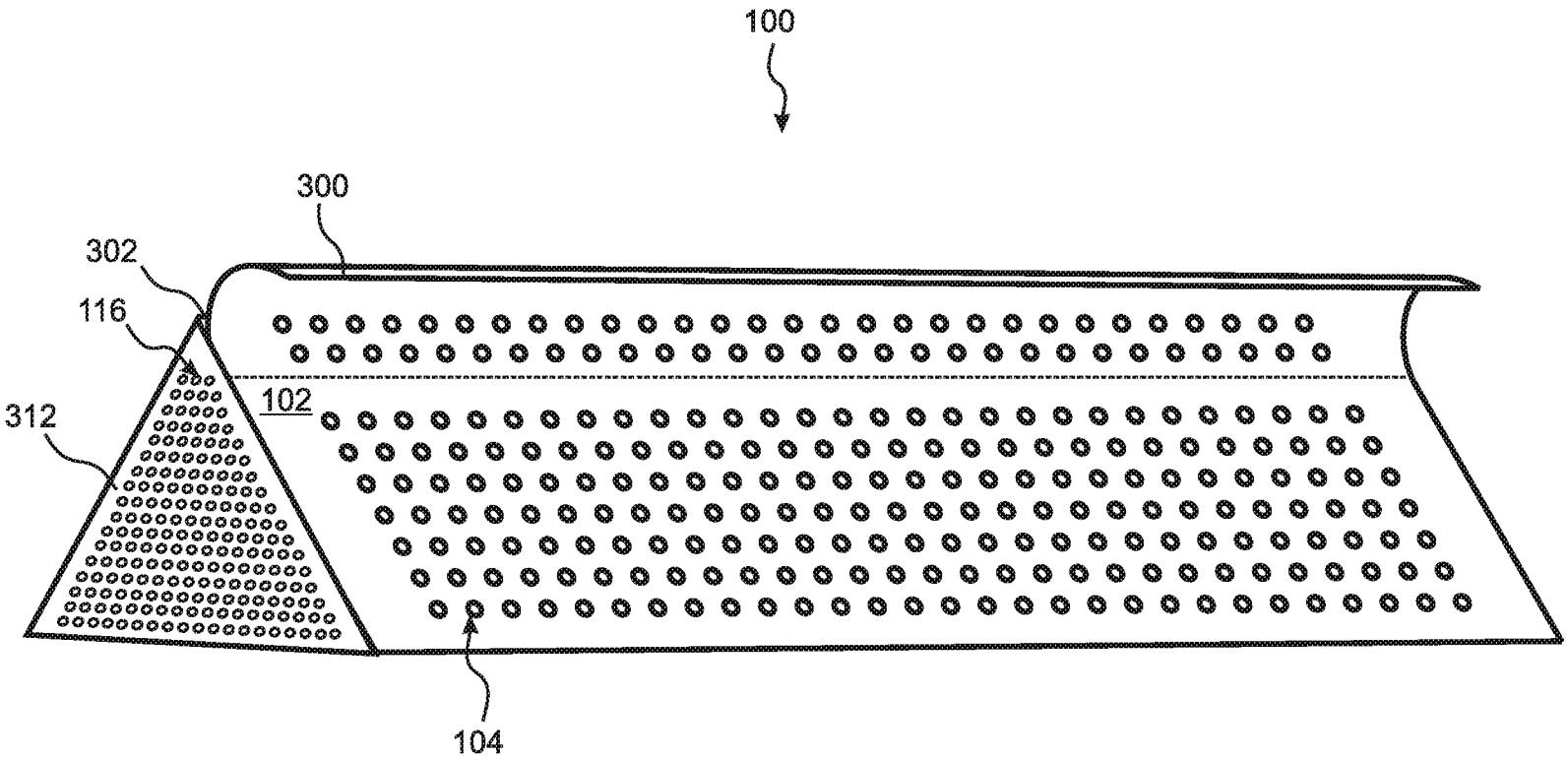
FIG. 3D is a perspective view from the front of the embodiment of FIG. 3A, shown with a side wall.

FIG. 3B illustrates the interaction between the apparatus 100 of FIG. 3A and water 106 flowing from a wave that has broken at a location seaward of the apparatus 100. As the water 106 flows up the front barrier 102 carrying entrained sand, some of the water 108 flows through the large holes 104 and into the interior 114 of the apparatus, where it forms a pool 306 that allows the entrained sand 308 to settle out of the water 306. For a strong surge of water 106, as is illustrated in FIG. 3B, some of the water 106 reaches the upper, curved portion 300 of the front barrier 102 and is directed seaward, so that it does not flow over the apparatus 100 and does not reach the sand behind the apparatus 100. Additional large holes are provided in the upper portion 300 of the front barrier 102, allowing additional water 310 to flow into an additional chamber 304 formed between the backstop wall 302 and the rear wall 112, where the water pools and allows entrained sand to settle. The pools of water then slowly drain out of the interior chambers 114, 304 through the small holes 116 provided in the rear wall 112 and backstop wall 302. A perspective view of the embodiment of FIG. 3A is presented in FIGS. 3C and 3D. In similar embodiments, the small holes 116 in the rear wall, backstop wall, and/or side walls 312 are provided by sections of screen, such as plastic or metal screen, that are incorporated into the walls.

Figure 4:
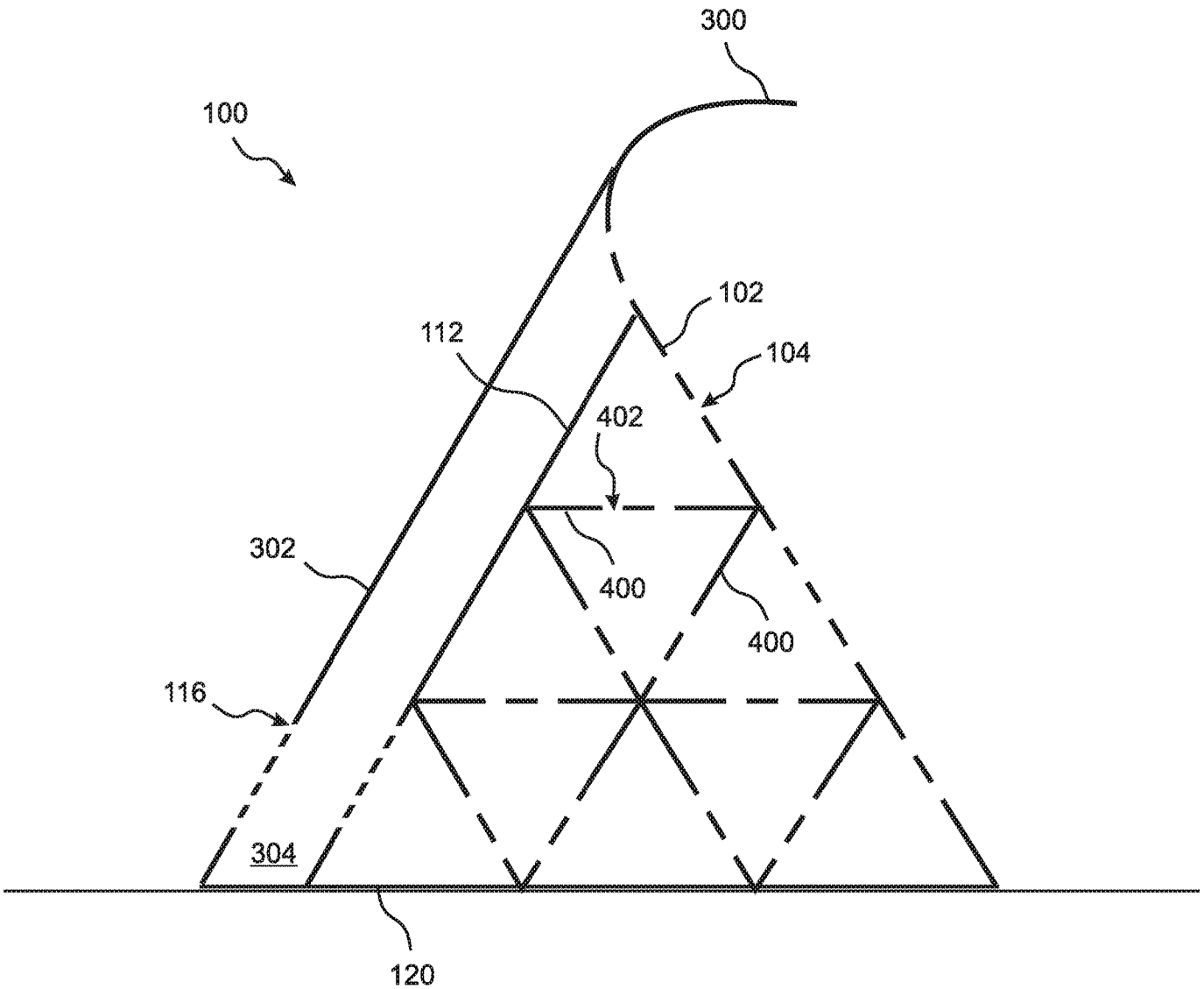
FIG. 4 is a cross-sectional view of an embodiment similar to FIG. 3A, but including structure-enhancing internal panels.

With reference to FIG. 4, some embodiments that require enhanced structural strength include internal partition walls 400 that extend between and reinforce the barrier wall 102 and rear wall 112. The partition walls 400 are penetrated by additional, interior large holes 402, so that water mixed with entrained sand that enters through the large holes 104 in the barrier wall 102 is able to flow downward through the interior large holes 402 to the bottom 120 of the apparatus interior 114.

While much of the description provided herein makes reference to "seawater" and "ocean" beaches, it should be noted that the disclosed invention is equally applicable to all sandy beaches that are exposed to wave action, including beaches adjacent to seas and large lakes.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application.

The invention illustratively disclosed herein suitably may be practiced in the absence of any element which is not specifically disclosed herein and is not inherently necessary. However, this specification is not intended to be exhaustive. Although the present application is shown in a limited number of forms, the scope of the invention is not limited to just these forms, but is amenable to various changes and modifications without departing from the spirit thereof. One of ordinary skill in the art should appreciate after learning the teachings related to the claimed subject matter contained in the foregoing description that many modifications and variations are possible in light of this disclosure. Accordingly, the claimed subject matter includes any combination of the above-described elements in all possible variations thereof, unless otherwise indicated herein or otherwise clearly contradicted by context. In particular, the limitations presented in dependent claims below can be combined with their corresponding independent claims in any number and in any order without departing from the scope of this disclosure, unless the dependent claims are logically incompatible with each other.

What is claimed is:

1. An apparatus for reducing beach erosion, the apparatus including:

a barrier wall having a top and a bottom, the barrier wall being inclined backward at an angle of at least 20 degrees from vertical;

a first plurality of holes penetrating the barrier wall;

a rear wall having a top and a bottom, the rear wall being located behind the barrier wall so that a chamber space is formed between the barrier wall and the rear wall; and a second plurality of holes penetrating the rear wall, the holes of the second plurality of holes being smaller in diameter than the holes of the first plurality of holes;

the first plurality of holes being configured to allow water to flow through the barrier wall and into the chamber space, and the second plurality of holes being configured to allow water to flow through the rear wall out of the chamber space.

2. The apparatus of claim 1 wherein the rear wall is inclined from vertical in a forward direction, so that the top of the rear wall is in contact with a rear surface of the barrier wall.

3. The apparatus of claim 1, wherein the thickness of the barrier wall is between ¼ inch and two inches.

4. The apparatus of claim 1, wherein the barrier wall and the rear wall are made from plywood, metal, fiberglass, particle board, micro-lattice, rigid foam, Styrofoam, graphene, and/or plastic.

5. The apparatus of claim 1, further comprising a bottom panel extending from the bottom of the rear wall to the bottom of the barrier wall.

6. The apparatus of claim 1, wherein the top of the barrier wall is curved forward.

7. The apparatus of claim 6, wherein:

the rear wall is inclined from vertical in a forward direction, so that the top of the rear wall is in contact with a rear surface of the barrier wall;

the curved top of the barrier wall extends above the top of the rear wall;

the apparatus further includes a backstop wall having a bottom and a top;

the bottom of the backstop wall is located behind the bottom of the rear wall;

the top of the backstop wall extends to the rear surface of the barrier wall at a height that is above the top of the rear wall, a secondary chamber space being formed between the backstop wall and the rear wall; and at least some of the first plurality of holes penetrate the barrier wall at heights between the top of the rear wall and the top of the backstop wall.

8. The apparatus of claim 1, further comprising at least one side wall.

9. The apparatus of claim 8, wherein at least one of the side walls is penetrated by a third plurality of holes.

10. The apparatus of claim 1, wherein the holes of the second plurality of holes have diameters that are less than ¼ inch.

11. The apparatus of claim 1, wherein the holes of the first plurality of holes have diameters that are between ¼ inch and 6 inches.

12. The apparatus of claim 1, further comprising a plurality of anchoring stakes configured to anchor the bottom of the barrier wall to underlying sand.

13. The apparatus of claim 1, further comprising a base that supports the barrier and rear walls, the base including a front retaining wall that extends vertically in front of the bottom of the barrier wall and a rear retaining wall that extends vertically behind the bottom of the rear wall.

14. The apparatus of claim 13, wherein the base is water-inflatable.

15. The apparatus of claim 13, wherein:

the top of the barrier wall is curved forward;

the rear wall is inclined from vertical in a forward direction, so that the top of the rear wall is in contact with a rear surface of the barrier wall;

the curved top of the barrier wall extends above the top of the rear wall;

the apparatus further includes a backstop wall having a bottom and a top;

the bottom of the backstop wall is located behind the bottom of the rear wall;

the top of the backstop wall extends to the rear surface of the barrier wall at a height that is above the top of the rear wall, a secondary chamber space being formed between the backstop wall and the rear wall:

at least some of the first plurality of holes penetrate the barrier wall at heights between the top of the rear wall and the top of the backstop wall; and the rear retaining wall extends vertically behind the bottom of the backstop wall.

16. The apparatus of claim 13, further comprising a plurality of anchoring stakes configured to anchor the base to underlying sand.

17. The apparatus of claim 1, wherein the barrier wall and front wall can be pivoted about their bottoms so as to overlap with each other in a substantially flat, folded configuration.

18. A method for reducing erosion of a sand beach that abuts a body of water, wherein the body of water generates waves that break onto the sand beach, the method comprising:

providing the apparatus of claim 1;

installing the apparatus on the sand beach in an orientation wherein the barrier wall faces the body of water, the apparatus being installed at a location above a highest location where the waves break, but in a location where water emitted by the breaking waves will reach the apparatus; and allowing sand entrained in the water reaching the barrier wall to accumulate within the apparatus behind the barrier wall and in front of the rear wall.

19. The method of claim 18, further comprising relocating the apparatus after sand has been accumulated therein, the accumulated sand being left behind as added beach sand.

20. The method of claim 19, wherein the apparatus is relocated closer to the water, the steps of allowing sand to accumulate and relocating the apparatus being repeated so as to progressively extend the beach toward the water.

* * * * *